US008289116B2

(12) United States Patent
Wolf et al.

(10) Patent No.: US 8,289,116 B2
(45) Date of Patent: Oct. 16, 2012

(54) IGNITION COIL FOR VEHICLE

(75) Inventors: Edgard Wolf, Chihuahua (MX); Albert Anthony Skinner, El Paso, TX (US); Mark Albert Paul, El Paso, TX (US)

(73) Assignee: Delphi Technologies, Inc., Troy, MI (US)

( * ) Notice: Subject to any disclaimer, the term of this patent is extended or adjusted under 35 U.S.C. 154(b) by 516 days.

(21) Appl. No.: 12/418,996

(22) Filed: Apr. 6, 2009

(65) Prior Publication Data

US 2010/0253455 A1 Oct. 7, 2010

(51) Int. Cl.

| | |
|---|---|
| ***H01F 27/02*** | (2006.01) |
| ***H01F 27/30*** | (2006.01) |
| ***H01F 38/12*** | (2006.01) |
| ***H01F 7/06*** | (2006.01) |

(52) U.S. Cl. ..... 336/92; 336/83; 336/90; 336/96; 336/198; 123/634; 123/635; 29/602.1

(58) Field of Classification Search ..... 336/83, 336/90, 92, 96, 198; 123/634, 635; 29/602.1
See application file for complete search history.

(56) References Cited

U.S. PATENT DOCUMENTS

| | | | | |
|---|---|---|---|---|
| 3,185,093 | A * | 5/1965 | Holinbeck | 102/202.2 |
| 3,255,512 | A * | 6/1966 | Lochner et al. | 29/602.1 |
| 4,985,984 | A * | 1/1991 | Umezaki | 29/602.1 |
| 5,015,982 | A * | 5/1991 | Skinner et al. | 336/69 |
| 6,216,679 | B1 * | 4/2001 | Skinner et al. | 123/635 |
| 2002/0101701 | A1 * | 8/2002 | Moga et al. | 361/247 |
| 2002/0171524 | A1 * | 11/2002 | Tsai | 336/96 |
| 2006/0251203 | A1 * | 11/2006 | Okamura et al. | 376/287 |

FOREIGN PATENT DOCUMENTS

JP 2000150285 A * 5/2000

OTHER PUBLICATIONS

RD 328076 A, Abstract, Publication Date: Aug. 10, 1991.*

* cited by examiner

*Primary Examiner* — Mohamad Musleh
*Assistant Examiner* — Tsz Chan
(74) *Attorney, Agent, or Firm* — Thomas N. Twomey

(57) ABSTRACT

A spark plug coil assembly has a primary core bearing primary windings and a secondary winding spool around which secondary windings are wound and in which the primary core is received. A case receives the spool with core. The entire case can be made of composite Iron to function as a magnetic return path for the core, or a composite Iron shield can be overmolded to an otherwise plastic case.

20 Claims, 2 Drawing Sheets

IGNITION COIL FOR VEHICLE

FIELD OF THE INVENTION

The present invention relates generally to vehicle ignition coils.

BACKGROUND OF THE INVENTION

Ignition coils are components that use the coupling between a primary winding and a secondary winding to transform relatively low voltages from the battery into high voltages that are supplied to the spark plugs in vehicle gasoline engines. The spark plugs start the internal combustion process that drives the rods and hence, crankshaft and axles. In older systems, a single ignition coil is provided, and a distributor sends the pulses from the coil through respective high voltage spark plug wires to the spark plugs in the cylinders in accordance with a timing that is established by the distributor.

In relatively modern engines, an engine can have several ignition coils, one for each cylinder or for each pair of cylinders, thereby advantageously eliminating the need for distributors and high voltage wires and also providing more precise control of the engine timing. One example of such an ignition coil system is set forth in U.S. Pat. No. 6,556,118, owned by the present assignee and incorporated herein by reference.

To provide a magnetic return path to the primary core around which the primary windings are wound, steel shields have been provided that surround the inside or outside of the case which holds the core. The primary core typically is centrally disposed in a secondary winding spool around which the secondary windings are wound, and the case holds the primary/secondary assembly. Such a shield, which also serves to direct flux to a main air gap that is associated with pole pieces, is described in U.S. Pat. No. 5,015,982, incorporated herein by reference.

SUMMARY OF THE INVENTION

As understood herein, when placed inside the case the above-mentioned steel shield tends to crack because of its low coefficient of thermal expansion, requiring buffers and special coatings to release from the steel to counteract. Alternatively, as understood herein placing the shield outside the case to reduce the risk of cracking requires anti-corrosion protection of the shield as well as grounding the shield, which increases complexity and cost and which can also lead to undesirable partial discharges that erode the case.

A spark plug coil assembly includes a primary core bearing primary windings and a secondary winding spool around which secondary windings are wound. The primary core is received in the spool. A case receives the spool with core. In one embodiment the case is made of composite Iron to function as a magnetic return path for the core.

In this embodiment the core can be made of composite Iron and the assembly has no magnetic shield. The core can be integrally formed with a pole piece on an end of the core. Also, if desired the core can be press fit into a depression of the case. In specific embodiments the entire case is 40%-70% by volume Iron particles injection molded into a thermoplastic carrier. The bottom of the case can be thicker than the wall of the case and the bottom may be formed with an opening through which a portion of a high voltage tower is pressed.

In another aspect, a spark plug coil assembly includes a primary core bearing primary windings and a secondary winding spool around which secondary windings are wound.

The primary core is received in the spool. A case receives the spool with core. In this embodiment the case can be made of electrically insulative material and a shield is overmolded to the case. The shield is made of composite Iron to function as a magnetic return path for the core.

In another aspect, a method includes providing a primary core bearing primary windings and a secondary winding spool around which secondary windings are wound. The primary core is received in the spool. The method includes surrounding the spool and core with one and only one composite Iron member to provide a magnetic flux return path for the core.

The details of the present invention, both as to its structure and operation, can best be understood in reference to the accompanying drawings, in which like reference numerals refer to like parts, and in which:

DETAILED DESCRIPTION OF THE PREFERRED EMBODIMENT

Figure 1:
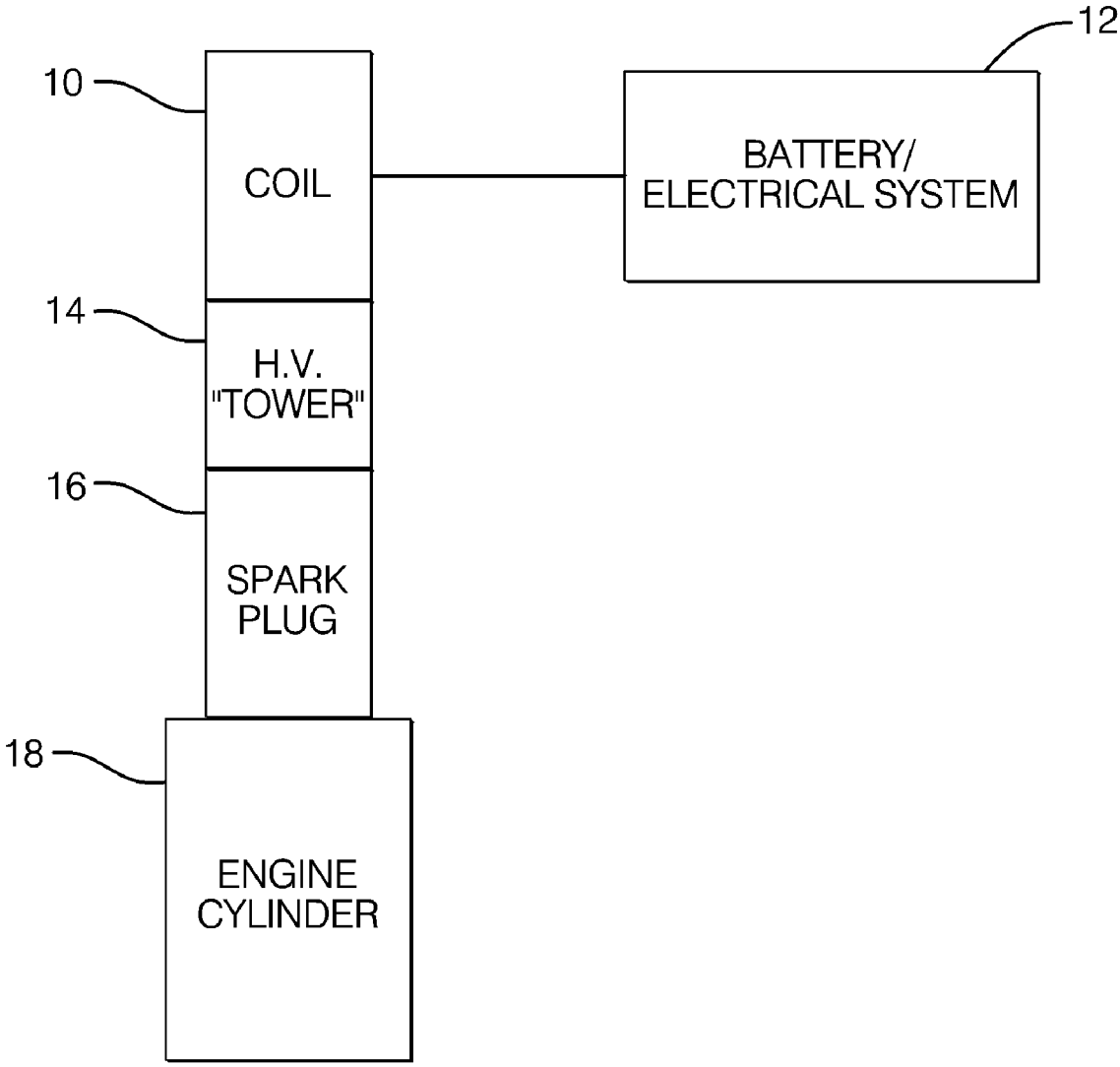
FIG. 1 is a schematic block diagram of the coil in an intended environment.

Referring initially to FIG. 1, a spark plug coil assembly is shown, generally designated 10, which can receive electrical power from a battery/electrical distribution system 12 of a vehicle and which can be coupled through a so-called "high voltage tower" 14 to one or more spark plugs 16, to provide combustion spark inside an engine cylinder 18. The HV tower 14 may include, without limitation, a cup and spring arrangement.

Figure 2:
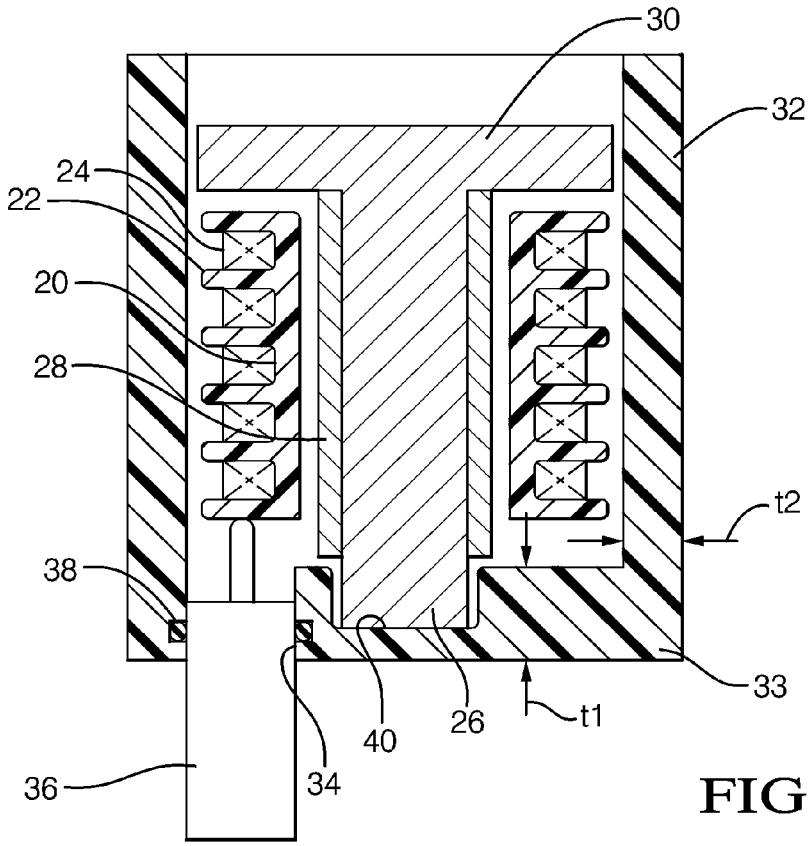
FIG. 2 is a cut-away side elevational view in partial cross-section of a first embodiment of the coil.

FIG. 2 shows the details of a first embodiment of the coil assembly 10, it being understood that various elements such as circuit boards, etc. which typically are included in coil assemblies are omitted for clarity. The assembly 10 includes an electrically insulated hollow secondary winding spool 20 that may be formed with plural radial ring-shaped ribs 22 for segment winding of a secondary coil 24 around the spool 20. In other embodiments the secondary coil may be progressively wound on the spool 20. In any case, it is to be understood that the spool 20 may be formed with one or more secondary winding terminals that can be electrically connected to the HV tower 14 shown in FIG. 1.

As shown in FIG. 2, the secondary winding spool 20 coaxially receives a primary core 26 around which a primary winding 28 is wound. The primary winding 28 receives electrical power from the distribution system 12 shown in FIG. 1. The primary core 26 can be made of compression molded composite Iron or laminated Iron with or without a pole piece. At an end of the core 26 as shown a pole piece 30 may be formed that is disc-shaped and that has a larger diameter than the remainder of the core, i.e., the pole piece 30 is radially enlarged relative to the rest of the core. When the pole piece is radially symmetrical as shown the core 26 with pole piece 30 establish a T-shaped cross section. The pole piece 30 may be made integrally with the core 26.

A hollow case 32 that may be generally U-shaped in the cross section shown centrally holds the spool 20 with primary core 26. The case 32 is made of composite Iron and more particularly may be 40%-70% by volume Iron particles injection molded into a thermoplastic carrier/fiberglass. As understood herein, by making the case 32 of composite Iron, the need for a second pole piece and a shield are eliminated, meaning that no magnetic shield is provided on the inside or outside surface of the case 32. Accordingly, the case 32 itself preferably is electrically grounded.

The case 32 can include a bottom 33 formed with an opening 34 through which a portion 36 of the high voltage tower 14 shown in FIG. 1 can be press fit, with an O-ring 38 being disposed between the portion 36 and walls of the opening 34 if desired to act as an epoxy seal. The portion 36 of the HV tower may be integral to the secondary spool 20 as shown or it may be a separately made piece of, e.g., glass-filled thermoplastic and then attached to the spool.

In the embodiment shown in FIG. 2, the bottom 33 defines a thickness "t1" that is greater than the thickness "t2" defined by the walls of the case 32 that are orthogonal to the bottom 33 as shown. This configuration serves advantageously to transfer flux to the walls.

The bottom 33 of the case 32 may also be centrally formed on its inside surface with a depression 40 into which the bottom end of the core 26 is press fit as shown.

Figure 3:
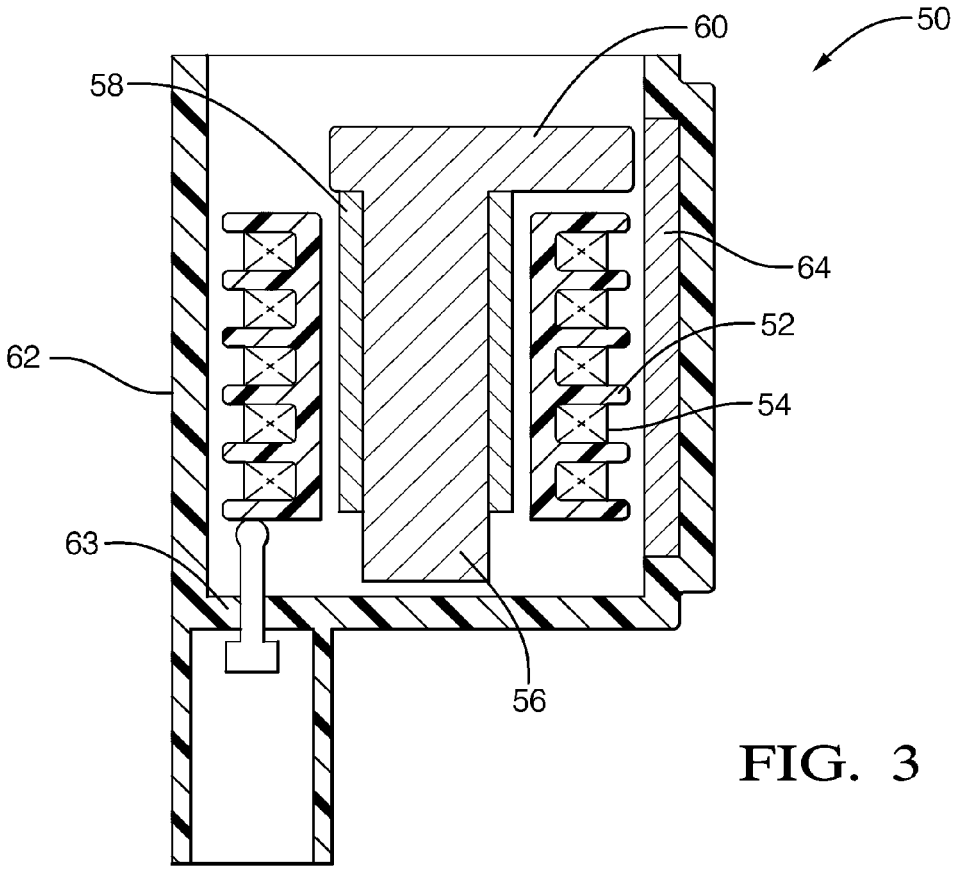
FIG. 3 is a cut-away side elevational view in partial cross-section of a second embodiment of the coil.

FIG. 3 shows a coil assembly 50 including a secondary winding spool 52, secondary windings 54, primary core 56, and primary windings 58 that may be substantially identical in configuration and operation to the like parts described above in reference to FIG. 2 (except that in FIG. 3 a radially enlarged but not radially symmetric pole piece 60 is formed on the end of the core 56 as shown).

A hollow case 62 that may be generally U-shaped in the cross section shown centrally holds the spool 52 with primary core 56. The case 62 may be made of plastic such as polyethylene terephthalate (PET) and may include a portion 63 of an HV tower. Unlike the embodiment shown in FIG. 2, the assembly 50 shown in FIG. 3 includes a magnetic shield 64 that may be overmolded onto the case 62 as shown. The shield 64 is made of composite Iron and more particularly may be 40%-70% by volume Iron particles injection molded into a thermoplastic carrier/fiberglass. The shield 64 may not completely surround the spool 52 as shown but instead may be formed into only one side of the case 62.

The shield 64 need not be grounded and can float electrically to minimize the capacitance it adds and thus avoid reducing the high voltage output by the assembly 50. Also, lower eddy current losses result with the shield 64 vis-a-vis a steel shield, and since the coefficient of thermal expansion of the shield is closer to that of plastic, the risk of cracking is reduced.

While the particular IGNITION COIL FOR VEHICLE is herein shown and described in detail, it is to be understood that the subject matter which is encompassed by the present invention is limited only by the claims.

What is claimed is:

1. Spark plug coil assembly comprising:

a primary core bearing primary windings;

a secondary winding spool around which secondary windings are wound, the primary core being received in the spool; and a case defining an exterior portion of the spark plug coil assembly and receiving the spool and core, the case being made of a composite comprising both Iron and one of thermoplastic and fiberglass to function as a magnetic return path for the core.

2. The assembly of claim 1, wherein the core is made of composite Iron or laminated Iron.

3. The assembly of claim 1, wherein the assembly has no magnetic shield inside or outside of the case.

4. The assembly of claim 1, wherein the core is integrally formed with a pole piece on an end of the core.

5. The assembly of claim 1, wherein the core is press fit into a depression of the case.

6. The assembly of claim 1, wherein the entire case is 40%-70% by volume Iron particles injection molded into the thermoplastic.

7. The assembly of claim 1, wherein the case is formed with a bottom and a wall orthogonal to the bottom, and the bottom is thicker than the wall.

8. The assembly of claim 7, wherein the bottom is formed with an opening through which a portion of a high voltage tower is pressed.

9. Spark plug coil assembly comprising:

a primary core bearing primary windings;

a secondary winding spool around which secondary windings are wound, the primary core being received in the spool;

a case receiving the spool and core, the case being made of electrically insulative material; and a shield overmolded to the case, the shield being made of a composite comprising both Iron and one of thermoplastic and fiberglass to function as a magnetic return path for the core.

10. The assembly of claim 9, wherein the core is made of composite Iron or laminated Iron.

11. The assembly of claim 9, wherein the core is integrally formed with a pole piece on an end of the core.

12. The assembly of claim 9, wherein the entire shield is 40%-70% by volume Iron particles injection molded into the thermoplastic.

13. The assembly of claim 9, wherein the case is formed with a bottom and a wall orthogonal to the bottom, and the bottom is thicker than the wall.

14. The assembly of claim 11, wherein the pole piece is not radially symmetric about the longitudinal axis of the primary core.

15. The assembly of claim 9, wherein the shield does not completely surround the spool.

16. Method comprising:

providing a primary core bearing primary windings and a secondary winding spool around which secondary windings are wound, the primary core being received in the spool; and at least partially surrounding the spool and core with one and only one member, the one and only one member being made of a composite comprising both iron and one of thermoplastic and fiberglass to provide a magnetic flux return path for the core.

17. The method of claim 16, wherein the member is a case holding the spool and core.

18. The method of claim 16, wherein the member is a shield overmolded to a case holding the spool and core.

19. The method of claim 16, wherein the member is 40%-70% by volume Iron particles injection molded into the thermoplastic.

20. The method of claim 16, wherein the core is made of compression molded composite Iron or laminated Iron.

* * * * *